US005433355A

United States Patent [19]

Watkins

[11] Patent Number: 5,433,355

[45] Date of Patent: Jul. 18, 1995

[54] CLOTHING PROTECTION APPARATUS

[76] Inventor: Herbert E. Watkins, 108 Sycamore La. East, Plant City, Fla. 33566

[21] Appl. No.: 243,361

[22] Filed: May 16, 1994

[51] Int. Cl.[6] ..... A41H 43/00; A47H 1/00; A47B 96/00

[52] U.S. Cl. ..... 223/1; 223/120; 223/DIG. 4; 211/123; 248/214; 248/215

[58] Field of Search ..... 223/1, 87, 98, 85, DIG. 2, 223/DIG. 3, DIG. 4; 248/214, 215; 211/123; 383/37

[56] References Cited

U.S. PATENT DOCUMENTS

| | | | |
|---|---|---|---|
| 1,294,916 | 2/1919 | Knight | 248/215 |
| 1,606,441 | 11/1926 | Nelms | 248/214 |
| 2,599,614 | 6/1952 | Dahlberg | 211/123 |
| 2,925,916 | 2/1960 | Pollock | 248/214 |
| 3,181,773 | 5/1965 | Jelling et al. | 383/37 |
| 4,123,024 | 10/1978 | Levy | 248/214 |
| 4,126,252 | 11/1978 | Wasserman | 223/87 |
| 4,846,430 | 7/1989 | Ke | 248/215 |
| 4,894,935 | 1/1990 | Kretz | 248/214 |
| 5,127,559 | 7/1992 | Freer et al. | 223/98 |

*Primary Examiner*—Clifford D. Crowder

*Assistant Examiner*—Bibhu Mohanty

[57] ABSTRACT

A clothing protection apparatus for protecting clothing or the like during storage and transportation. The apparatus having a top attachment device to secure onto the top of a door thus allowing the user to easily manipulate the invention during use. A looping hook is use to secure the invention onto a clothing rail when the invention is not in use. A lower attachment device is provided to support a clothing hanger and the accompanying garment for positioning before a protective cover is to be installed. A common roll of protective covering is provided with perforations between each cover. To use the device, a clothing hanger and clothing garment is placed onto the lower attachment device whereupon the protective covering is unrolled while simultaneously being wrapped around the clothing garment until the first perforation of the cover is reached. The protective cover is then torn at the perforation and the hook of the clothing hanger is pulled through the opening provided at the top of the protective cover. The clothing hanger is then removed for storage with the clothing garment being protected by the protective cover. The above steps are repeated for other clothing articles.

16 Claims, 5 Drawing Sheets

CLOTHING PROTECTION APPARATUS

BACKGROUND OF THE INVENTION

This invention relates to the protection of clothing articles during storage and transportation. More specifically, this invention is an apparatus that provides a plurality of protective covers from a roll to cover and protect a plurality of clothing articles. This invention also allows a single user to independently wrap and protect a plurality of clothing articles quickly and easily.

It has been customary to store clothes in common types of plastic covers to prevent dust and other contaminants from getting on expensive or valuable clothing articles. Typically the task of storing clothes inside of plastic covers requires two people to accomplish, one person to hold the cover open, and the other person to insert the clothing article. One such problem arises when the user tries to accomplish the task independently primarily because the plastic covers that are used are very thin and difficult to handle.

Several approaches have been provided for the storage of clothing articles, in Furst U.S. Pat. No. 3,834,497, "A storage bag which can be used for camping or the like is substantially flat when not being used to accommodate articles so that it can be folded or rolled into a package of low bulk when stored. The bag is used in connection with a conventional clothes hanger and has an inner chamber for storing bulky items. Quick access to this chamber is provided by a slit or opening through a flat surface of the bag. Further, many additional articles may be stored in the bag by providing pockets on the front and rear surfaces thereof, which pockets are substantially flush with the flat bag when no articles are being stored therein." While this invention has its advantages, it does not provide a plurality of bags to accommodate a plurality of clothing articles to be covered for storage. Additionally, this type of storage device requires the user to hold the storage device with one hand while the other hand tries to insert the clothing article into a thin slit which is difficult. Furthermore, this type of storage device with all of its features makes the device expensive to protect a large number of clothing articles.

Another approach is taught by Kuroishi in U.S. Pat. No. 4,919,262, wherein "A portable clothes cover in which the clothes hanging down from the hanger or the like can be directly suspended on the suspender member of the upper bar, then enclosed by the cover section, and the cover section thus enclosing the clothes together with the hanger or the like can be securely maintained in the folded condition by folding this assembly in two and thereby locking the upper and lower bars to each other, followed by putting the sheath-like bag onto the cover section thus folded." A disadvantage of this portable clothes cover is that it will be too expensive to provide individual covers for each clothing article to be protected. Additionally, it may be too difficult for the average user to apply this method.

Still another approach is taught in the art of Creamer in U.S. Pat. No. 3,961,710 wherein "A clothes hanger support and storage assembly for conventional type wire clothes hanger is described and having an elongate base support member to which are connected a hanger support rod and a hanger retaining member such that clothes hangers positioned with their head portions on the hanger support rod contact the hanger retaining member and are prevented from tangling." While this invention has its advantages, it deals only with the storage of clothes hangers and does not directly apply to the storage and protection of clothing articles garments.

SUMMARY OF THE INVENTION

Accordingly, it is an object of this invention to provide the user with a device that allows a single person to easily wrap clothing articles with commonly used protective covers for protection during storage and transportation.

Another object of this invention is to provide a clothing hanger affixing means located adjacent and below a roll of protective covers to allow the clothes hangers to hang with the clothing articles attached thereto.

Still another object of this invention is to provide a clothing rail affixing means to secure onto a clothing rail to store the invention when the invention is not in use.

Still yet another object of this invention is to provide a vertical space between the clothing affixing means and a support member to allow a protective cover to wrap around most or the entire garment before the perforation part of the protective cover is cut.

A further object of this invention is to provide a door affixing means to secure to the top of a door while the invention is in use. This puts the invention in a convenient location ready for use.

Still a further object of this invention is to provide a pair of disassembly joints that allows the invention to be separated at these joints thereby allowing the invention to be stored compactly for easy storage or travel.

Another object of this invention is to save time by allowing a single independent user to easily and quickly protect and store clothing articles, rather than to need the help of an additional person during this process.

A further object of this invention is to provide a flexible rolled holder supports that will allow the rolled protective covers to be installed or removed easily for the user.

In carrying out this invention in the illustrative embodiment thereof, a clothing protection apparatus is provided for the protection of clothing articles during long term storage and transportation.

Conveniently, the user may assemble the clothing protection apparatus by attaching the upper door affixing section of the invention to the rolled protective cover support and the lower hanger affixing means to the roll supporting member. Next, a roll of protective covers is installed by pulling apart the flexible roll support members and inserting each side into the inner cavity of the rolled protective covers. The door attachment is then hung over the top center of a door allowing the clothing protection apparatus to hang freely. Then, a clothes hanger with the clothing article to be covered is hung on the invention at the clothing affixing means site where the user then pulls down the first protective bag around the garment until the first perforation is located. The protective cover is then torn at the perforated mark and the hook of the clothing hanger is pulled through the opening provided at the top of the protective cover. The clothing hanger is then removed from the clothing affixing means site along with the clothing garment and protective cover and ready for storage. The next clothing hanger along with the next clothing article to be covered is then installed onto the clothing affixing means site and the above steps are repeated until all the desired clothes are protected. When the task is completed, the user may conveniently store the clothing protection apparatus onto a clothing rail using the clothing rail affixing means provided. The user may also disassemble the clothing hanger apparatus at the disassembly joints and store then for compact storage or transportation.

BRIEF DESCRIPTION OF THE DRAWINGS

This invention, together with other objects, features, aspects and advantages thereof, will be more clearly understood from the following description, considered in conjunction with the accompanying drawings.

Five sheets of drawings are furnished, sheet one contains FIG. 1, sheet 2 contains FIGS. 2, sheet 3 contains FIG. 3, sheet 4 contains FIG. 4, and sheet 5 contains FIG. 5.

FIG. 1 shows a protective cover being unrolled down and around a clothing garment to be covered.

DESCRIPTION OF THE PREFERRED EMBODIMENTS

Figure 1:
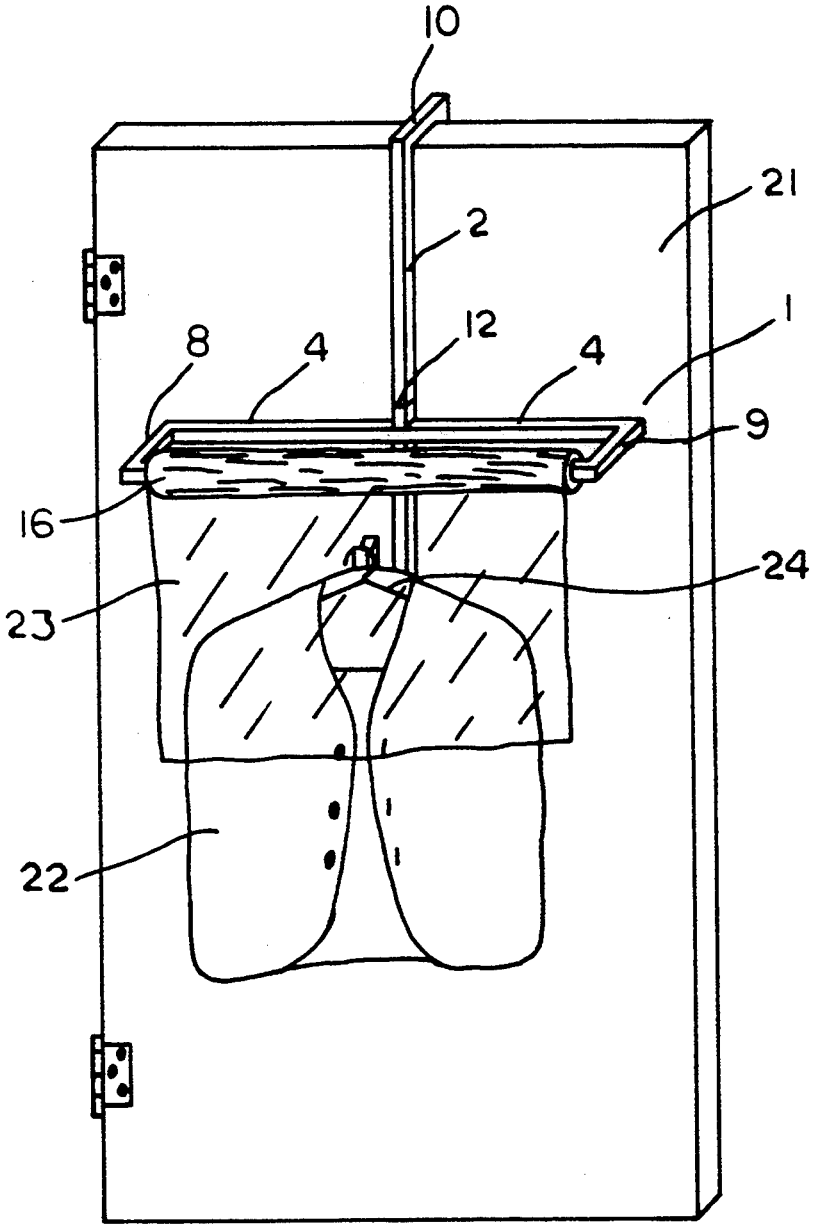
FIG. 1 is an orthographic view of the clothing protection apparatus completely assembled and installed onto the top of a door.

Referring now to FIG. 1, a clothing protection apparatus referred to generally by the reference numeral 1 is made of a door affixing supporting member 2 which is affixed to a door top affixing means 10. The door top affixing means is shown hanging over the top of a door 21. At the other end of the door affixing supporting member 2 is a removeable affixing joint 12 that can be completely separated when needed. FIG. 1 shows the a pair of flexible roll supporting members 4 affixed to the door affixing support member 2 via removeable affixing joint 12. At each end of the flexible roll supporting members 4 are affixed a pair of extending supporting arms 8 and 9 to accommodate for various diameters of rolls to be installed. A protective cover roll 16 is shown installed on the extending supporting arms 8 and 9 and the roll 16 is partially unrolled exposing a single protective cover 23. The protective cover 23 is shown partially installed over a clothing hanger 24 and a clothing article 22.

Figure 2:
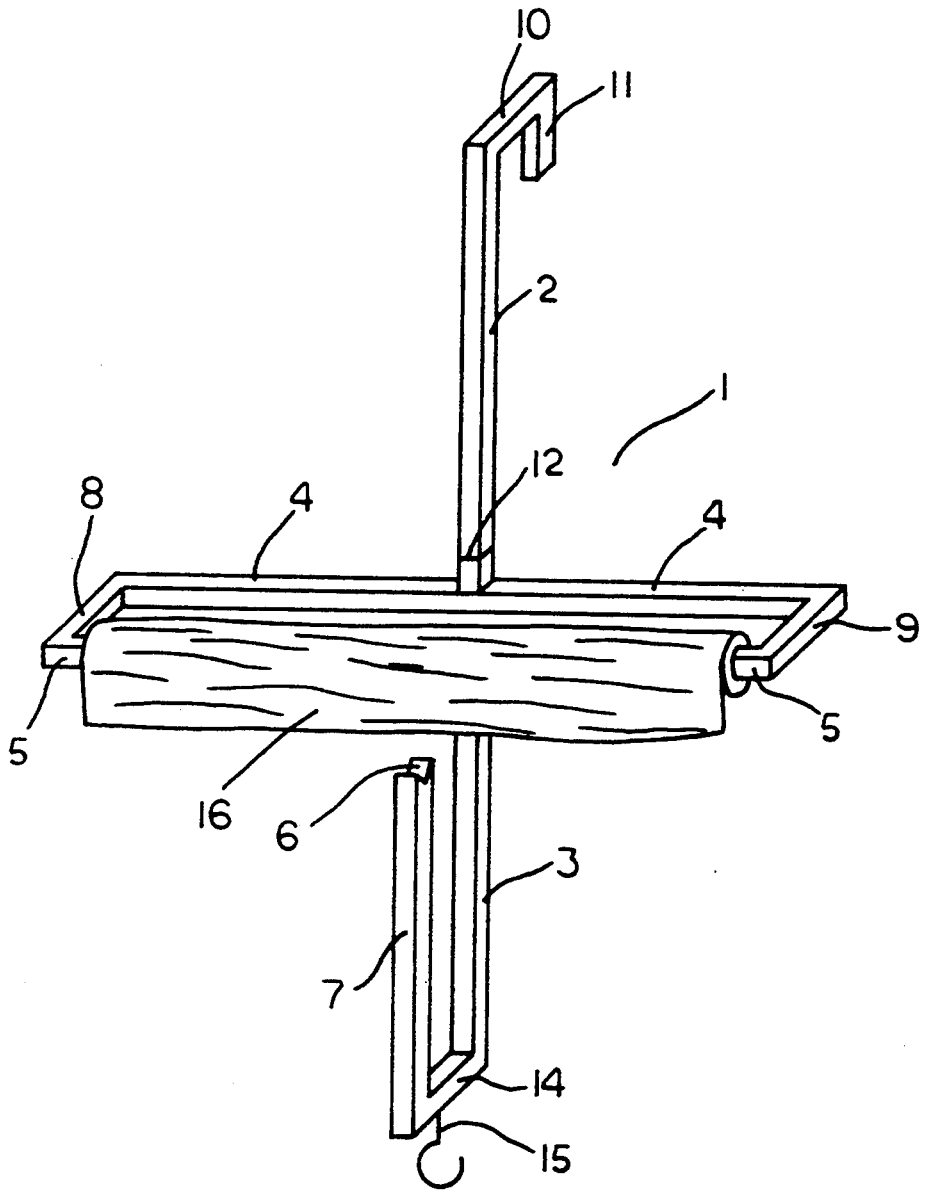
FIG. 2 is an orthographic view of the clothing protection apparatus clearly showing a clothing rail holder, a door attachment holder, a clothing affixing means, a roll of protective covers.

Referring now to FIG. 2 we see the clothing protection apparatus 1 completely assembled having a door affixing supporting member 2 which is affixed to a door top affixing means 10. The door top affixing means having a locking tab 11 at one end to secure the apparatus to a door. At the other end of the door affixing supporting member 2 is a removeable affixing joint 12 that can be completely separated when needed. FIG. 2 shows the a pair of flexible roll supporting members 4 affixed to the door affixing support member 2 via removeable affixing joint 12. Affixed at each end of the flexible roll supporting members 4 are a pair of extending roll supporting arms 8 and 9 to accommodate for various diameters of rolled protective covers to be installed. Affixed to each end of the extending roll supporting arms 8 and 9 are roll inserts 5 that are used to be inserted into a hollow cavity of a protective cover roll 16. A protective cover roll 16 is shown installed on the extending supporting arms 8 and 9 and roll inserts 5. A lower vertical supporting member 3 is shown affixed to a bottom supporting member 14. Affixed to the bottom supporting member 14 is a clothing rail affixing means 15 used to secure onto a clothing rail when the invention is not in used. Affixed to one end of the bottom supporting member 14 and extending upwards, is a clothing hanger supporting member 7 with a clothing hanger supporting means 6 located at the top.

Figure 3:
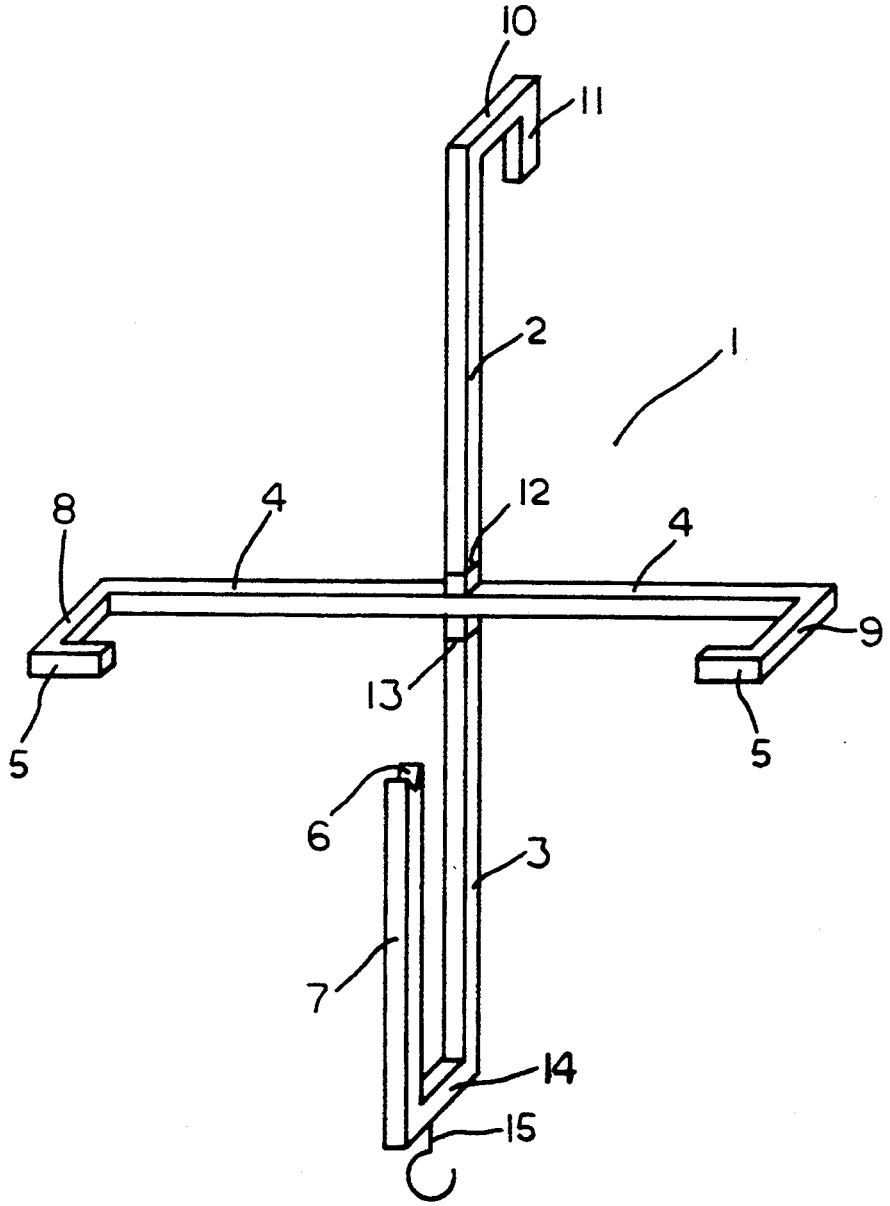
FIG. 3 is an orthographic view of the clothing protection apparatus less the roll of protective covers thereby exposing the roll holding devices. Additionally, both assembly joints are shown adjacent to the roll support members.

Referring next to FIG. 3, we see the clothing protection apparatus 1 partially assembled having a door affixing supporting member 2 which is affixed to a door top affixing means 10. The door top affixing means having a locking tab 11 at one end thereby allowing the apparatus 1 to be secured to a door. At the other end of the door affixing supporting member 2 is a removeable affixing joint 12 that can be completely separated when needed. FIG. 3 shows the a pair of flexible roll supporting members 4 affixed to the door affixing support member 2 via removeable affixing joint 12. Affixed at each end of the flexible roll supporting members 4 are a pair of extending roll supporting arms 8 and 9 to accommodate for various diameters of rolled protective covers to be installed. Affixed to each end of the extending roll supporting arms 8 and 9 are roll inserts 5 that are used to be inserted into a hollow cavity of a protective cover roll 16. A lower vertical supporting member 3 is shown affixed to the flexible roll supporting members 4 via a removeable affixing joint 13. At one end, the lower vertical supporting member 3 is affixed to a bottom supporting member 14. Affixed to the bottom supporting member 14 is a clothing rail affixing means 15 used to secure onto a clothing rail when the invention is not in use. Affixed to one end of the bottom supporting member 14 and extending upwards, is a clothing hanger supporting member 7 with a clothing hanger supporting means 6 located at the top.

Figure 4:
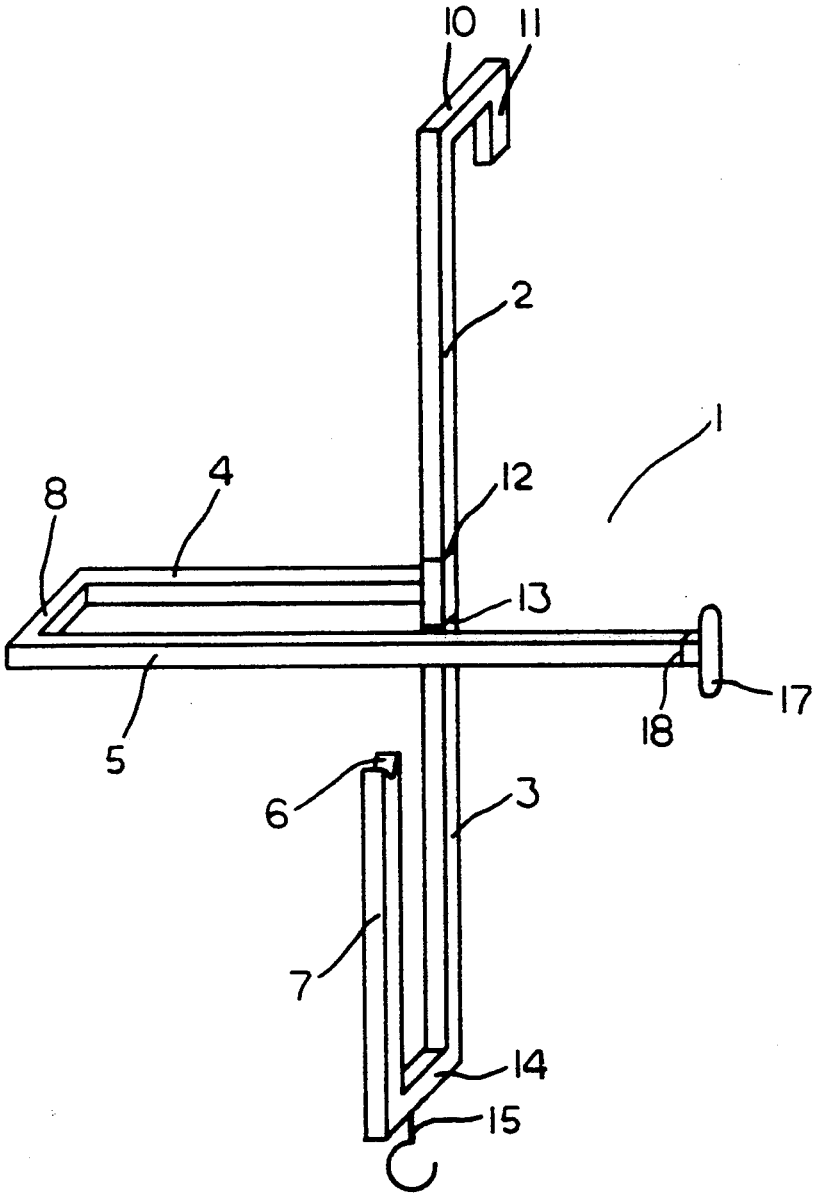
FIG. 4 is an orthographic view of the clothing protection apparatus with a different type of roll holder. The roll holder having a removeably affixed handle at one end wherein when removed, a roll of protective covers is inserted onto the bar and the handle is reattached.

Referring to FIG. 4, we see the clothing protection apparatus 1 partially assembled having a door affixing supporting member 2 which is affixed to a door top affixing means 10. The door top affixing means having a locking tab 11 at one end thereby allowing the apparatus 1 to be secured to a door. At the other end of the door affixing supporting member 2 is a removeable affixing joint 12 that can be completely separated when needed. FIG. 4 shows a flexible roll supporting member 4 affixed to the door affixing support member 2 via removeable affixing joint 12. Affixed to one end of the flexible roll supporting member 4 is a extending roll supporting arm 8 to accommodate for various diameters of rolled protective covers to be installed. Affixed to one end of the extending roll supporting arm 8 is a roll insert 5 that are used to be inserted into a hollow cavity of a protective cover roll 16. A handle 17 is shown affixed to the roll insert via removeable affixing joint 18. A lower vertical supporting member 3 is shown affixed to the flexible roll supporting member 4 via a removeable affixing joint 13. At one end, the lower vertical supporting member 3 is affixed to a bottom supporting member 14. Affixed to the bottom supporting member 14 is a clothing rail affixing means 15 used to secure onto a clothing rail when the invention is not in use. Affixed to one end of the bottom supporting member 14 and extending upwards, is a clothing hanger supporting member 7 with a clothing hanger supporting means 6 located at the top.

Figure 5:
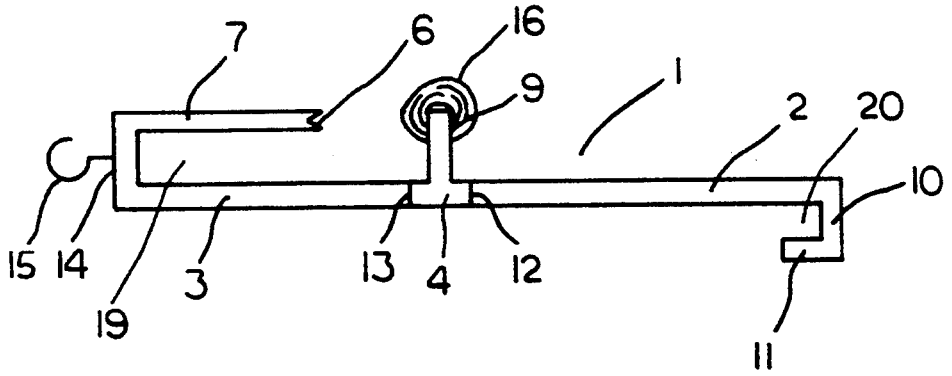
FIG. 5 is a side horizontal view of the clothing protection apparatus clearly showing the space between the clothing affixing means and the lower structural member to to allow the protective covering to be pulled down around the clothing garment to be protected.

Referring to FIG. 5, we see a side horizontal view of the clothing protection apparatus 1 partially assembled having a door affixing supporting member 2 affixed to a door top affixing means 10. The door top affixing means having a locking tab 11 at one end thereby allowing the apparatus 1 to be secured to a door. The locking tab 11, supporting member 2 and the door top affixing means 10 forms a cavity 20 which is large enough to accept the thickness of a door 21. At the other end of the door affixing supporting member 2 is a removeable affixing joint 12 that can be completely separated when needed. FIG. 5 shows a flexible roll supporting member 4 affixed to the door affixing support member 2 via removeable affixing joint 12. Affixed to one end of the flexible roll supporting member 4 is a extending roll supporting arm 9 to accommodate for various diameters of rolled protective covers to be installed. A lower vertical supporting member 3 is shown affixed to the flexible roll supporting member 4 via a removeable affixing joint 13. At one end, the lower vertical supporting member 3 is affixed to a bottom supporting member 14. Affixed to the bottom supporting member 14 is a clothing rail affixing means 15. Affixed to one end of the bottom supporting member 14 and extending upwards, is a clothing hanger supporting member 7 with a clothing hanger supporting means 6 located at the top.

Accordingly, a very unique, attractive, convenient method and apparatus are provided for protecting clothing articles from dust and other contaminants when the garments are in storage or during transportation.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A clothing protection apparatus for protecting clothing, the clothing protection apparatus comprising:

(a) at least one door affixing means having a rod of a given length, said rod having a substantially U-shaped end inverted to affix over the top of a door, said rod having a threadlike joint at the end opposite the U-shaped end; and, (b) at least one rolled protective cover support removeably affixed to said door affixing means via said threadlike joint, said rolled protective cover support having a pair of laterally extending supporting members of a given length, said lateral supporting members having a substantially U-shaped configuration at each end, each of both said U-shaped configurations having one end serving as an insert to extend in a cavity of a rolled protective cover, said U-shaped configurations having a rolled protective cover affixed therebetween; and, (c) at least one clothing hanger support affixed to said rolled protective cover support via a threadlike affixing joint, said clothing hanger support having a substantially U-shaped configuration with said threadlike affixing joint at one end, said clothing hanger support having a clothing hanger affixing means at the end opposite said threadlike joint; and, (d) a clothing rail affixing means affixed to said clothing hanger support at the bottom part of the U-shaped configuration.

2. A clothing protection apparatus as set forth in claim 1 wherein said rolled protective cover support being made of a flexible material to allow said lateral support members to bend outward thereby allowing a rolled protective cover to fit.

3. A clothing protection apparatus as set forth in claim 1 wherein said lateral supports having a length greater than the length of said rolled protective cover.

4. A clothing protection apparatus as set forth in claim 1 wherein said roll inserts having a diameter less than the diameter of said cavity of said rolled protective cover.

5. A clothing protection apparatus as set forth in claim 1 wherein said rolled protective cover is rotatably affixed therebetween said roll inserts.

6. A clothing protection apparatus as set forth in claim 1 wherein said cavity of said U-shaped ends of said are able to accommodate the diameter of said rolled protective cover thereby allowing said rolled protective cover to spin easily.

7. A clothing protection apparatus as set forth in claim 1 wherein said clothing hanger affixing means having a cavity large enough to accept the hook end of a clothes hanger.

8. A clothing protection apparatus as set forth in claim 1 wherein said clothing rail affixing means having a semi-looped configuration.

9. A clothing protection apparatus for protecting clothing, the clothing protection apparatus comprising:

(a) at least one door affixing means having a rod of a given length, said rod having a substantially U-shaped end inverted to affix over the top of a door, said rod having a threadlike joint at the end opposite the U-shaped end; and, (b) at least one rolled protective cover support removeably affixed to said door affixing means via said threadlike joint, said rolled protective cover support having a laterally extending supporting member of a given length, said lateral supporting member having a substantially U-shaped configuration, said U-shaped configuration having one end serving as a roll insert to extend in a cavity of a rolled protective cover, said U-shaped configuration having a rolled protective cover affixed thereto; and, (c) at least one clothing hanger support affixed to said rolled protective cover support via a threadlike affixing joint, said clothing hanger support having a substantially U-shaped configuration with said threadlike affixing joint at one end, said clothing hanger support having a clothing hanger affixing means at the end opposite said threadlike joint; and, (d) a clothing rail affixing means affixed to said clothing hanger support at the bottom part of the U-shaped configuration.

10. A clothing protection apparatus as set forth in claim 9 wherein said roll insert having a length greater than the length of said rolled protective cover.

11. A clothing protection apparatus as set forth in claim 9 wherein said roll insert having a diameter less than the diameter of said inner cavity of said rolled protective cover.

12. A clothing protection apparatus as set forth in claim 9 wherein said rolled protective cover is rotatably affixed thereto said roll insert whereinafter a handle is affixed.

13. A clothing protection apparatus as set forth in claim 9 wherein said U-shaped configuration of said rolled protective cover support forming a cavity large enough to accommodate the diameter of said rolled protective cover thereby allowing said rolled protective cover to spin easily.

14. A clothing protection apparatus as set forth in claim 9 wherein said clothing hanger affixing means having a cavity large enough to accept the hook end of a clothes hanger.

15. A clothing protection apparatus as set forth in claim 9 wherein said clothing rail affixing means having a semi-looped configuration.

16. A clothing protection apparatus as set forth in claim 9 wherein the apparatus includes handle having a length larger than said diameter of said cavity of said rolled protective cover.

* * * * *